US011576459B2

(12) United States Patent
Cheney et al.

(10) Patent No.: US 11,576,459 B2
(45) **Date of Patent: *Feb. 14, 2023**

(54) ADJUSTABLE FOOTBEDS FOR FOOTWEAR

(71) Applicant: FAST IP, LLC, Vineyard, UT (US)

(72) Inventors: Craig Cheney, Lindon, UT (US); Seth Munger, Springville, UT (US); Aislynn Edwards, Schenectady, NY (US); Danielle Bullock, Colorado Springs, CO (US)

(73) Assignee: FAST IP, LLC, Lindon, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/345,292

(22) Filed: Jun. 11, 2021

(65) Prior Publication Data

US 2021/0298409 A1 Sep. 30, 2021

Related U.S. Application Data

(63) Continuation of application No. 16/927,489, filed on Jul. 13, 2020, now Pat. No. 11,051,577.

(60) Provisional application No. 63/004,850, filed on Apr. 3, 2020, provisional application No. 62/957,822, filed on Jan. 7, 2020.

(51) Int. Cl.

| | |
|---|---|
| ***A43B 3/26*** | (2006.01) |
| ***A43B 17/00*** | (2006.01) |
| ***A43B 7/1464*** | (2022.01) |

(52) U.S. Cl.

CPC ..... *A43B 3/26* (2013.01); *A43B 7/1464* (2022.01); *A43B 17/006* (2013.01)

(58) Field of Classification Search

CPC ..... A43B 3/26; A43B 7/1465; A43B 13/386; A43B 13/40; A43B 17/0006

USPC ..... 36/81, 97, 44, 150, 155, 159, 160, 100

See application file for complete search history.

(56) References Cited

U.S. PATENT DOCUMENTS

| | | | | | |
|---|---|---|---|---|---|
| 1,208,638 | A | * | 12/1916 | Phillips | A43B 7/142 36/181 |
| 1,673,126 | A | * | 6/1928 | Sarra | A43B 7/1464 36/163 |
| 1,932,658 | A | * | 10/1933 | Goodfriend | A43B 3/0078 36/43 |
| 2,089,798 | A | * | 8/1937 | Howell | A43B 7/1464 36/161 |
| 2,433,329 | A | * | 12/1947 | Adler | A43B 21/32 36/44 |
| 2,776,499 | A | * | 1/1957 | Guintini | A43B 3/246 36/61 |
| 3,442,031 | A | * | 5/1969 | Antell | A43B 3/26 36/43 |
| 4,807,372 | A | * | 2/1989 | McCall | A43D 999/00 36/131 |
| 4,813,157 | A | * | 3/1989 | Boisvert | A43B 7/1445 36/145 |
| 5,768,803 | A | * | 6/1998 | Levy | A43B 17/02 36/43 |
| 6,000,147 | A | * | 12/1999 | Kellerman | A43B 17/02 36/44 |

(Continued)

*Primary Examiner* — Marie D Bays

(57) ABSTRACT

A footbed having at least one of a thickness adjustment panel and a lateral adjustment fin, each configured to be moved between a first configuration and a second configuration, the first and second configurations providing different fits of a shoe into which the footbed is inserted.

13 Claims, 6 Drawing Sheets

(56) References Cited

U.S. PATENT DOCUMENTS 6,205,685 B1 * 3/2001 Kellerman ..... A43B 1/0072 36/44
6,408,543 B1 * 6/2002 Erickson ..... A43B 7/16 36/28
8,291,616 B2 * 10/2012 DiGangi ..... A43B 7/142 36/71
11,051,577 B1 * 7/2021 Cheney ..... A43B 17/006
2006/0059726 A1 * 3/2006 Song ..... A43B 7/1464 36/144
2006/0107552 A1 * 5/2006 Clark ..... A43B 3/26 36/31
2008/0127518 A1 * 6/2008 Byrne ..... A43B 7/1445 36/97
2008/0178493 A1 * 7/2008 Scofield ..... A43B 7/142 36/43
2009/0172972 A1 * 7/2009 Rosen ..... A43B 7/1464 36/43
2011/0185600 A1 * 8/2011 Malek ..... A43B 17/18 36/43
2011/0302805 A1 * 12/2011 Vito ..... A43B 7/1464 36/145
2013/0219744 A1 * 8/2013 Case ..... A43B 17/023 36/43
2014/0013619 A1 * 1/2014 Irving ..... A43B 3/26 36/71
2014/0123516 A1 * 5/2014 Cressman ..... A43B 1/0054 36/83
2014/0259752 A1 * 9/2014 Feldman ..... A43B 7/1464 36/43
2017/0318898 A1 * 11/2017 Totty ..... A43B 7/1464
2018/0070670 A1 * 3/2018 Granger ..... A43B 7/1405
2018/0255872 A1 * 9/2018 Manasiya ..... A43B 17/035
2019/0125032 A1 * 5/2019 Liu ..... A43B 7/1464

* cited by examiner

ADJUSTABLE FOOTBEDS FOR FOOTWEAR

CROSS-REFERENCE TO RELATED APPLICATIONS

This application is a continuation of, claims priority to and the benefit of U.S. patent application Ser. No. 16/927,489, filed Jun. 13, 2020 entitled Adjustable footbeds for footwear. The '489 application claims the benefit of U.S. Provisional Patent Application No. 62/957,822, filed Jan. 7, 2020 entitled "Adjustable Footbeds for Footwear," and U.S. Provisional Patent Application No. 63/004,850, filed Apr. 3, 2020 entitled "Adjustable Footbeds for Footwear." All of the aforementioned applications are incorporated herein by reference in their entireties.

FIELD

The present disclosure relates to adjustable footbeds for footwear.

BACKGROUND

The present disclosure addresses fit problems in the footwear industry, including the cost of returns related to incorrect fit (in particular in the DTC channel), inventory requirements relating to half sizes and certain wide/narrow sizes, changing morphology of feet for many reasons (e.g., growth, pregnancy, injury, swelling), dynamic footwear needs across different activities (e.g., walking, running, relaxing, recovering), disparate sizes between left and right feet, rapid growth of children's feet before shoes wear out, and other various needs for periodic adjustment of shoe size.

SUMMARY

Disclosed herein, in accordance with example embodiments, are adjustable footbeds for footwear.

Example embodiments of the present disclosure comprise a footbed having a forward portion, a rearward portion, an arch portion, a thickness adjustment panel, and a lateral adjustment fin. The thickness adjustment panel can be coupled to a lower surface of the footbed and configured to be translated between a first panel configuration having a first footbed dimension and a second panel configuration having a second footbed dimension different from the first footbed dimension. In example embodiments, the thickness adjustment panel overlaps the forward portion of the footbed in the first panel configuration. In example embodiments, the thickness adjustment panel overlaps the rearward portion of the footbed in the second panel configuration. The lateral adjustment fin can be coupled to a lateral portion of the footbed and configured to be translated between a first fin configuration and a second fin configuration. In example embodiments, the lateral adjustment fin is adjacent the forward portion of the footbed in the first fin configuration. In example embodiments, the lateral adjustment fin overlaps the arch portion of the footbed in the second fin configuration.

Other example embodiments of the present disclosure comprise a footbed having a forward portion, a rearward portion, and a thickness adjustment panel. In such embodiments, the footbed can have a forward thickness and a rearward thickness. The thickness adjustment panel can be coupled to a lower surface of the footbed and configured to be translated between a first panel configuration and a second panel configuration. In example embodiments, the thickness adjustment panel overlaps the forward portion of the footbed in the first panel configuration. In example embodiments, the thickness adjustment panel overlaps the rearward portion of the footbed in the second panel configuration. In such embodiments, the forward thickness can be decreased by a first extent from the first panel configuration to the second panel configuration, while the rearward thickness can be increased by a second extent from the first panel configuration to the second panel configuration. In such embodiments, the thickness adjustment panel can comprise a plurality of projections, while the rearward portion can comprise a plurality of depressions. In this regard, in the second panel configuration, the plurality of projections can be configured to be received at least in part into the plurality of depressions such that the second extent is less than the first extent.

Still other example embodiments of the present disclosure comprise a shoe having a footbed, wherein the footbed comprises a forward portion, a rearward portion, and a thickness adjustment panel. The thickness adjustment panel can be coupled to the footbed and configured to be translated between a first panel configuration and a second panel configuration. In example embodiments, the thickness adjustment panel at least partially overlaps the forward portion of the footbed in the first panel configuration. In example embodiments, the thickness adjustment panel at least partially overlaps the rearward portion of the footbed in the second panel configuration. In various embodiments, the thickness adjustment panel can be temporarily coupled in the first panel configuration. In various embodiments, the thickness adjustment panel can be removed or temporarily coupled in the second panel configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
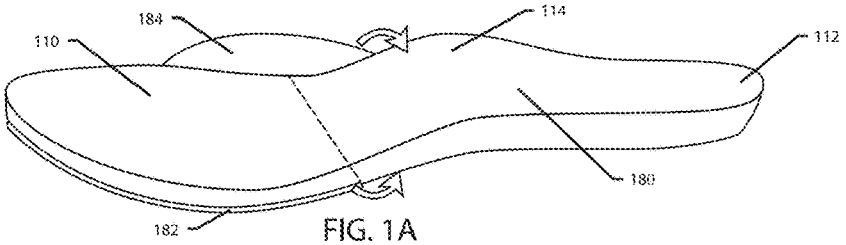
FIGS. 1A-1F illustrate various footbeds having thickness adjustment panels and lateral adjustment fins in different configurations, in accordance with example embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the adjustable footbeds for footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the adjustable footbeds for footwear. These terms should be given meaning according to the manner in which the adjustable footbeds for footwear is most typically designed for use, with the adjustable footbeds for footwear on a user's foot and with the user's shod foot disposed on or ready for placement on an underlying surface. Thus, these directions may be understood relative to the adjustable footbeds for footwear in such use. Similarly, as the adjustable footbeds for footwear is intended primarily for use as footwear, terms such as "inner," "inward," "outer," "outward," "innermost," "outermost," "inside," "outside," and the like should be understood in reference to the adjustable footbeds for footwear's intended use, such that inner, inward, innermost, inside, and the like signify relatively closer to the user's foot, and outer, outward, outermost, outside, and the like signify relatively farther from the user's foot when the adjustable footbeds for footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

As used herein, a "footbed" refers to a footbed, insole, sock liner or the like.

As used herein, "translated" means moved, including but not limited to folded, slid and rotated.

In accordance with example embodiments, the present disclosure provides for an adjustable footbed to provide for length, girth and/or width adjustability of a shoe into which the footbed is placed.

Figure 1B:
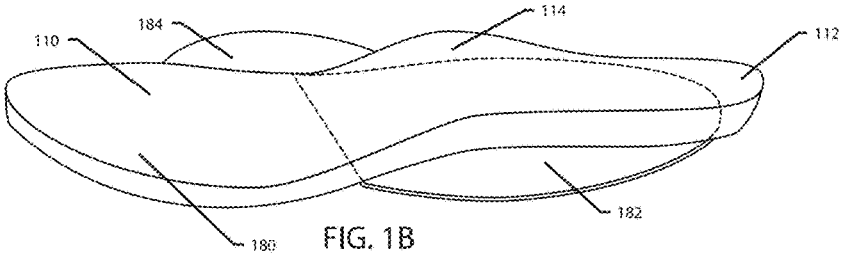
Figure 1C:
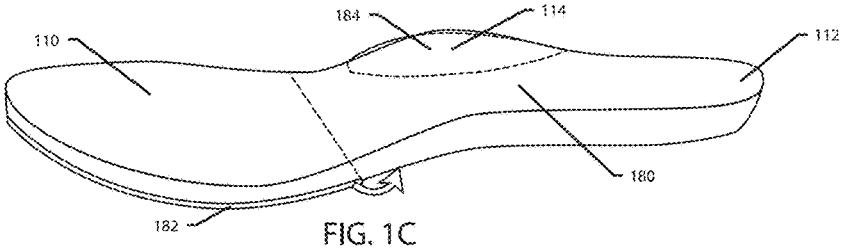
Figure 1D:
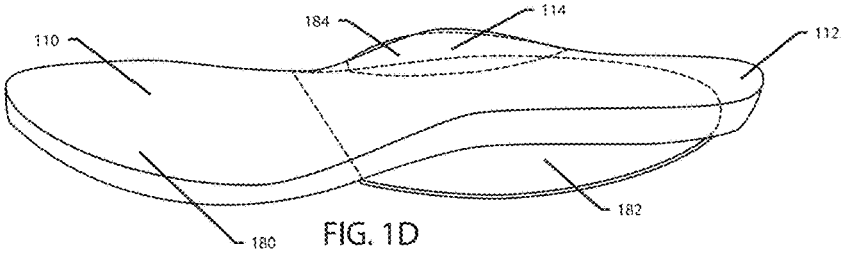

With reference to FIGS. 1A, 1B and 1D, a footbed 180 of a shoe 100 can comprise a foldable (or otherwise translatable, as described below) thickness adjustment panel 182. Folding can be achieved by the thickness adjustment panel 182 extending from (i.e., thickness adjustment panel 182 and footbed 180 are a unitary piece) and/or being hingedly coupled to the footbed 180, for example, with a material or portion thereof weaker or thinner (e.g., scored or perforated) than the material of which the thickness adjustment panel 182 and/or the footbed 180 is/are comprised. In addition to facilitating folding, a score, perforation or the like located where the thickness adjustment panel 182 is coupled to and/or extends from the footbed 180 can direct desired folding of the thickness adjustment panel 182 relative to the footbed 180, e.g., to align surface features, as described below. Thickness adjustment panel 182 can have a uniform or variable thickness, for example, to provide for comfort and/or support (e.g., at or near an arch portion 114 of footbed 180).

The thickness adjustment panel 182 can extend from and/or be coupled to a portion of footbed 180 between ends of footbed 180 (i.e., substantially equidistance between ends or not). The thickness adjustment panel 182 can be located on an upper or a lower surface of footbed 180. In some embodiments, one or both opposing surfaces/sides of the thickness adjustment panel 182 are smooth or substantially smooth.

In still other embodiments, thickness adjustment panel 182 is the same component as forward portion 110 or rearward portion 112, such that forward portion 110 is removeable or can be translated to overlap rearward portion 112 (footbed 180 having no forward structure after forward portion 110 being removed or translated) and/or rearward portion 110 is removeable or can be translated to overlap forward portion 112 (footbed 180 having no rearward structure after rearward portion 110 being removed or translated).

In various embodiments, when the thickness adjustment panel 182 is translated toward the forward portion 110 of footbed 180, the effective thickness of the forward portion 110 of footbed 180 (i.e., forward thickness of footbed) is increased and effective thickness of the rearward portion 112 of footbed 180 (i.e., rearward thickness of footbed) is decreased such that an inner dimension (e.g., girth) of shoe 100 within its forward portion is reduced to accommodate a smaller forefoot, while an inner dimension of shoe 100 within its rearward portion is increased in some embodiments.

In various embodiments, when the thickness adjustment panel 182 is translated toward the rearward portion 112 of footbed 180, the effective thickness of the forward portion 110 of footbed 180 is decreased and effective thickness of the rearward portion 112 of footbed 180 is increased such that an inner dimension (e.g., girth) of shoe 100 within its forward portion is increased to accommodate a larger forefoot, while an inner dimension of shoe 100 within its rearward portion is decreased in some embodiments.

Figure 2A:
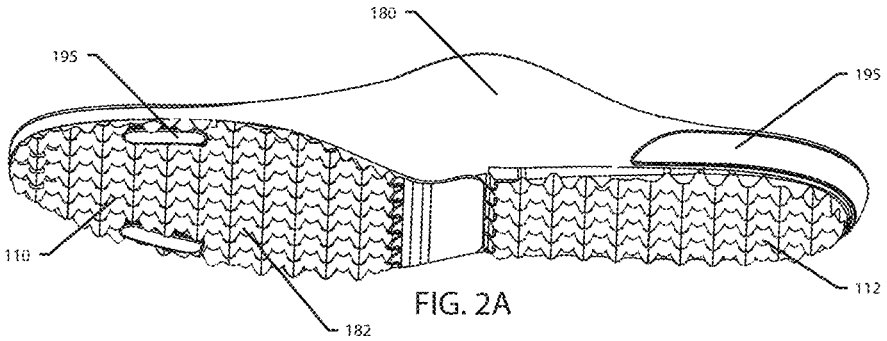
FIGS. 2A-2C illustrate different configurations of an example embodiment of a footbed having a foldable thickness adjustment panel.
Figure 2B:
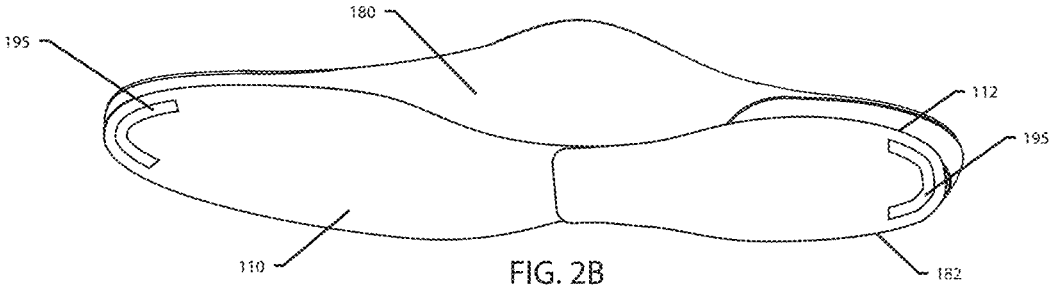

In some embodiments, and with reference to FIGS. 2A and 2B, the rearward portion of footbed 180 may have a plurality of surface features (e.g., positive structures, projections, or the like) configured to be received by a plurality of corresponding surface features (e.g., negative structures, depressions, absence of projections, or the like) on an opposing side of the thickness adjustment panel 182 (e.g., the other side being smooth). In this regard, when the thickness adjustment panel 182 is translated toward the rearward portion 112 of footbed 180, the effective thickness of the forward portion 110 of footbed 180 is decreased while the effective thickness of the rearward portion 112 of footbed 180 stays substantially the same or only nominally increases. In this regard, an inner dimension of shoe 100 within its rearward portion is not decreased, or is only minimally decreased (i.e., only an inner dimension in the shoe's forward portion is affected by the changed configuration). Stated differently, in example embodiments, in translating the thickness adjustment panel from the forward portion to the rearward portion, the rearward portion thickness is not increased or only increased to an extent less than the extent the forward portion thickness is decreased.

In still other embodiments, the forward portion of footbed 180 may have a plurality of surface features configured to be received by a plurality of corresponding surface features on an opposing side of the thickness adjustment panel 182 (e.g., the other side being smooth). In this regard, when the thickness adjustment panel 182 is translated toward the forward portion 110 of footbed 180, the effective thickness of the rearward portion 112 of footbed 180 is decreased while the effective thickness of the forward portion 110 of footbed 180 stays substantially the same or only nominally increases. In this regard, an inner dimension of shoe 100 within its forward portion is not decreased, or is only minimally decreased (i.e., only an inner dimension in the shoe's rearward portion is affected by the changed configuration). Stated differently, in example embodiments, in translating the thickness adjustment panel 182 from the rearward portion 112 to the forward portion 110, the forward portion thickness is not increased or only increased to an extent less than the extent the rearward portion thickness is decreased.

Interlocking of surface features as described herein (including with reference to the lateral adjustment fin 184) can provide the additional or alternate advantage of being configured to provide lateral support of the thickness adjustment panel 182 relative to the rearward portion 112 and/or forward portion 110 when overlapped.

Figure 3A:
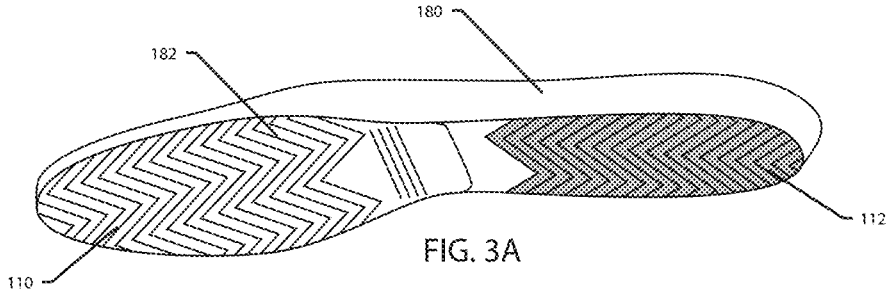
FIGS. 3A-3C illustrate alternate surface feature patterns for foldable thickness adjustment panels.
Figure 3B:
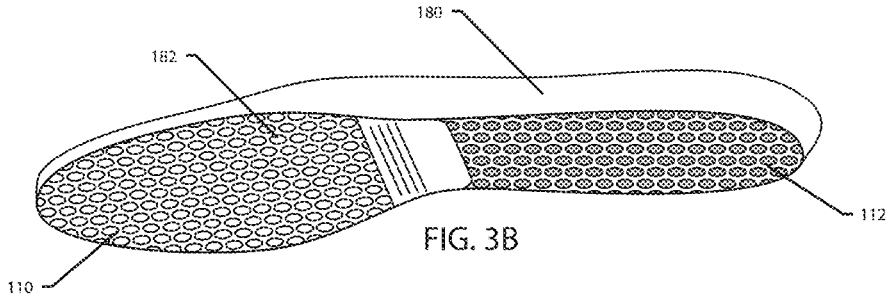
Figure 3C:
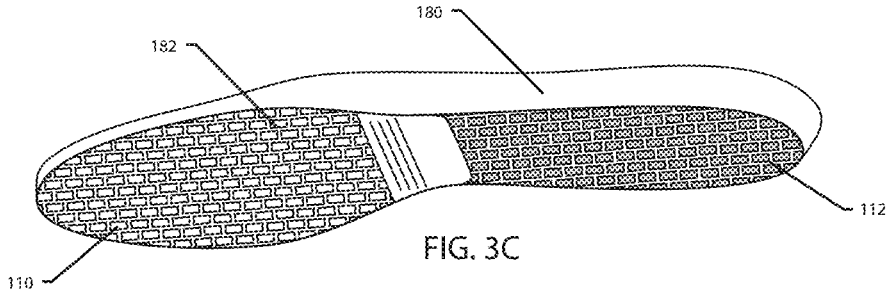

The surface features described herein (including those with reference to the lateral adjustment fin 184) can be configured to self-align and/or have multiple alignments (e.g., permit alignment at various degrees of folding, sliding and rotating). The surface features can comprise "egg crate" or "waffle" pattern (e.g., as illustrated in FIG. 2A), a plurality of zig-zags (e.g., as illustrated in FIG. 3A), a plurality of ellipses (e.g., as illustrated in FIG. 3B), a plurality of quadrilaterals (e.g., as illustrated in FIG. 3C) or other multi-faceted patterns.

In some embodiments, a negative surface feature can be an aperture (i.e., have two openings). In some embodiments, a positive surface feature (and a pattern thereof) can extend into, or completely through, an aperture that is a negative surface feature (and a pattern thereof). The surface features can comprise interlocking elements (e.g., zipper teeth or hook and loop fasteners).

The surface features described herein (again, including those with reference to the lateral adjustment fin 184) can comprise patterns of one or more elliptical, non-elliptical, or seemingly random shapes.

As used herein, an "elliptical" shape refers to any shape that generally lacks a point where two lines, curves, or surfaces converge to form an angle. For example, an "elliptical" shape encompasses traditional Euclidian geometric shapes such as circles and ellipses, as well as other non-angular shapes (that lack any angles), even if those shapes do not have designations common in Euclidian geometry.

As used herein, a "non-elliptical" shape refers to any shape that includes at least one point where two lines, curves, or surfaces converge to form an angle. For example, a "non-elliptical" shape encompasses traditional Euclidian geometric shapes such as triangles, rectangles, squares, hexagons, trapezoids, pentagons, stars, and the like as well as other shapes that have at least one angle even if those shapes do not have designations common in Euclidian geometry.

With continued reference to FIGS. 2A and 2B, in some embodiments, the thickness adjustment panel 182 is temporarily coupled in the forward and/or rearward positions, for example, by one or more coupling elements 195 or the like. As used herein, a "coupling element" can comprise one or more of an adhesive, stitch, hook and loop fastener, button, clip, grommet, zipper and other means known in the art or hereinafter developed.

In example embodiments, the coupling elements 195 are on one or both sides of the thickness adjustment panel 182 and/or on one or both of forward portion 110 and rearward portion 112 of the footbed 180.

Figure 2C:
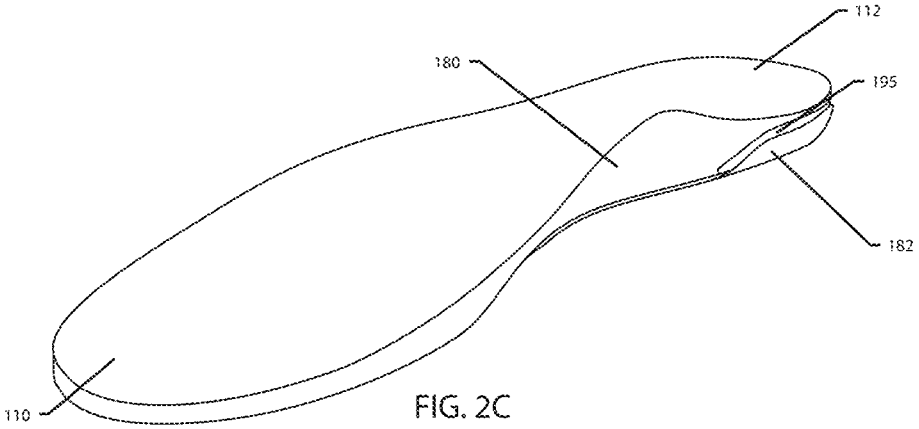

With reference to FIG. 2C, recognizing that the surface area of a forward portion of footbed 180 may be larger than that of a rearward portion of footbed 180, in some embodiments, a rearward portion of the footbed 180 comprises coupling elements 195 on a lateral side of the footbed 180, to receive the thickness adjustment panel 182 which is folded around the lateral sides of the rearward portion of the footbed 180. In this regard, in some embodiments the thickness adjustment panel 182 is received into a cutout along a vertical sidewall of the rearward portion 112 of footbed 180 to inset the excess mass and thereby prevent lateral thickness buildup.

Figure 1E:
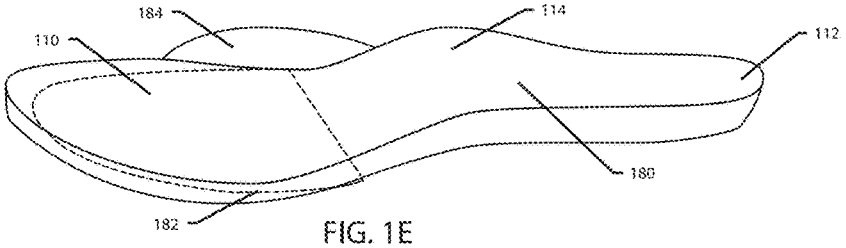
Figure 1F:
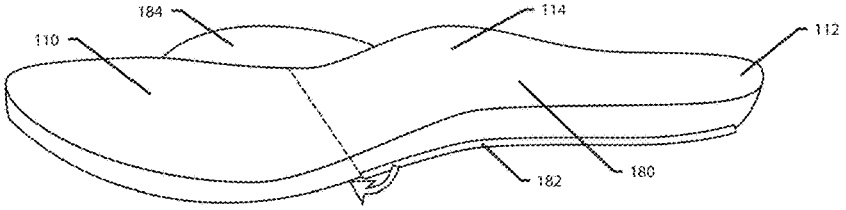

While the foregoing embodiments have been described with the thickness adjustment panel 182 being sized to generally follow the circumference of the forward portion 110 of the footbed 180 (have substantially the same surface area of forward portion 110 and thus have a larger surface area in one or more dimensions than rear portion 112), in various embodiments, and with reference to FIGS. 1E and 1F, the thickness adjustment panel 182 may be sized to generally follow the circumference of the rear portion 112 of the footbed 180 (have substantially the same surface area of rearward portion 110 and thus have a smaller surface area in one or more dimensions than forward portion 110).

Figure 4A:
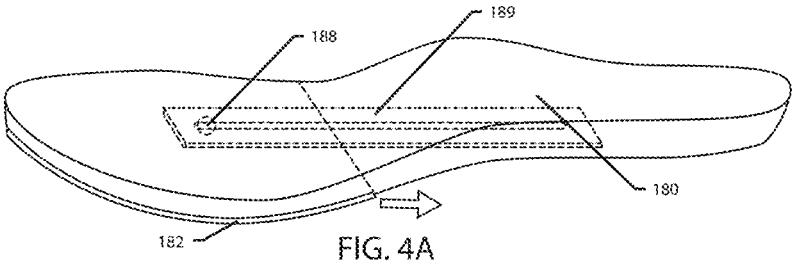
FIGS. 4A and 4B illustrate different configurations of an example embodiment of a footbed having a slideable thickness adjustment panel.
Figure 4B:
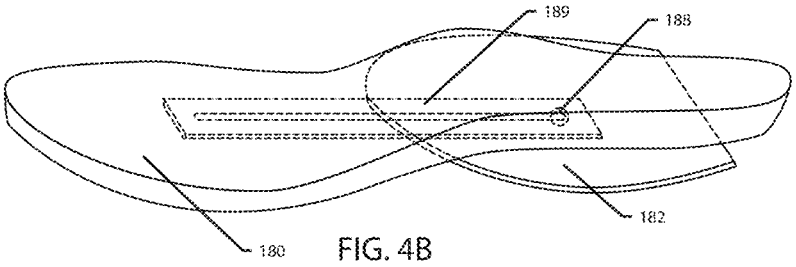

With reference to FIGS. 4A and 4B, a thickness adjustment panel 182 can be slideably coupled to a footbed 180, for example, along a track forward and rearward on an underside portion of footbed 180, or embedded within footbed 180. In the illustrated embodiment, the pin 188 is fixed relative to the thickness adjustment panel 182 and the track 189 is fixed relative to the footbed 180, however, in other embodiments, the pin can be fixed relative to the footbed 180 and the track can be fixed relative to the thickness adjustment panel 182.

In example embodiments, a forward and/or rearward pull cord can be attached to the thickness adjustment panel 182 and/or the pin 188 (and/or to the track 189 in the other referenced embodiment) to facilitate sliding between configurations. Such pull cord can be manually or electronically activated (e.g., with a motor).

Figure 5A:
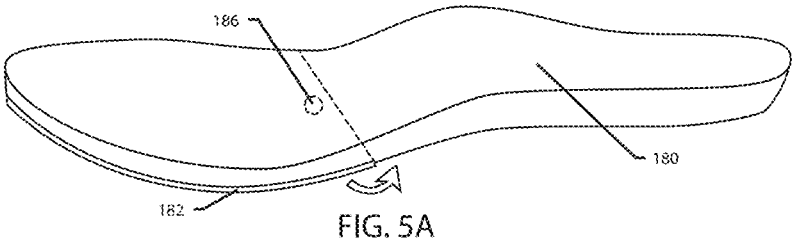
FIGS. 5A and 5B illustrate different configurations of an example embodiment of a footbed having a rotatable thickness adjustment panel.
Figure 5B:
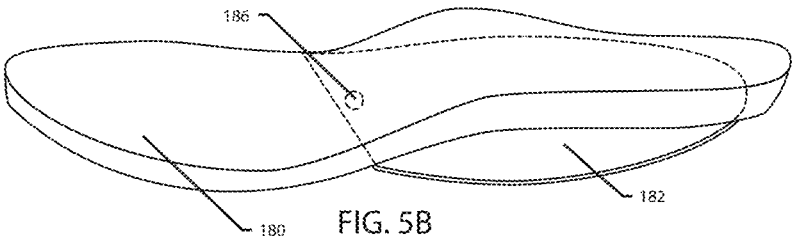

With reference to FIGS. 5A and 5B, a thickness adjustment panel 182 can be rotatably coupled to a footbed 180, for example, about a pin 186 coupled to a portion of footbed 180.

While a single thickness adjustment panel 182 is illustrated, multiple thickness adjustment panels 182 are contemplated, for example, to provide for multiple levels of adjustability. In such embodiments, one or more thickness adjustment panels 182 can have different thicknesses.

In example embodiments, one or more thickness adjustment panels 182 can have size designations (e.g., size n, size n+0.5, size n+1) imprinted thereon or affixed thereto.

In still other embodiments, one or more thickness adjustment panels 182 are completely detachable from the footbed 180.

With reference back to FIGS. 1A, 1C and 1D, a footbed 180 of a shoe 100 can comprise a foldable (or otherwise translatable, as described below) lateral adjustment fin 184. As above, folding can be achieved by the lateral adjustment fin 184 extending from (i.e., lateral adjustment fin 184 and footbed 180 are a unitary piece) and/or being hingedly coupled to the footbed 180, for example, with a material or portion thereof weaker or thinner (e.g., scored or perforated) than the material of which the lateral adjustment fin 184 and/or the footbed 180 is/are comprised. In addition to facilitating folding, a score, perforation or the like located where the lateral adjustment fin 184 is coupled to and/or extends from the footbed 180 can direct desired folding of the lateral adjustment fin 184 relative to the footbed 180, e.g., to align surface features, as described below. In some embodiments, the hinge coupling between lateral adjustment fin 184 and footbed 180 can be configured to tolerate some rotation, in addition to folding, for example, in connection with embodiments comprising a flange, as described below. Lateral adjustment fin 184 can have a uniform or variable thickness.

The lateral adjustment fin 184 can extend from and/or be coupled to a lateral portion of footbed 180 (e.g., at or near an arch portion 114 of footbed 180). The lateral adjustment fin 184 can be located on an upper or a lower surface of footbed 180. In some embodiments, one or both opposing surfaces/sides of the lateral adjustment fin 184 are smooth or substantially smooth.

In various embodiments, when the lateral adjustment fin 184 is translated toward the forward portion 110 (and/or the topside portion in some embodiments) of footbed 180, the effective thickness of the arch portion 114 of footbed 180 is decreased such that an inner dimension of shoe 100 within its forward portion is reduced to accommodate a smaller foot, while an inner dimension of shoe 100 within its rearward portion (which comprises arch portion 114) is increased in some embodiments.

In various embodiments, when the lateral adjustment fin 184 is translated toward the rearward portion 112 (and/or the underside portion of the arch portion 114 in some embodiments) of footbed 180, the effective thickness of the arch portion 114 of footbed 180 is increased such that an inner dimension of shoe 100 within its forward portion is increased to accommodate a larger foot, while an inner dimension of shoe 100 within its rearward portion (which comprises arch portion 114) is decreased in some embodiments.

Additionally or alternatively, and similar to embodiments described with reference to the thickness adjustment panel 182, the lateral adjustment fin 184 of footbed 180 may have a plurality of surface features on a side (e.g., the other side being smooth) configured to be received by a plurality of corresponding surface features on an opposing side of the footbed 180 (e.g., at an arch portion 114). In this regard, when the lateral adjustment fin 184 is translated toward the rearward portion 112 of footbed 180, the effective thickness of the arch portion 114 of footbed 180 stays substantially the same or only nominally increases. In this regard, an inner dimension of shoe 100 within its rearward portion is not changed, or is only minimally changed (i.e., only an inner dimension in the shoe's forward portion is affected by the changed configuration).

Figure 6A:
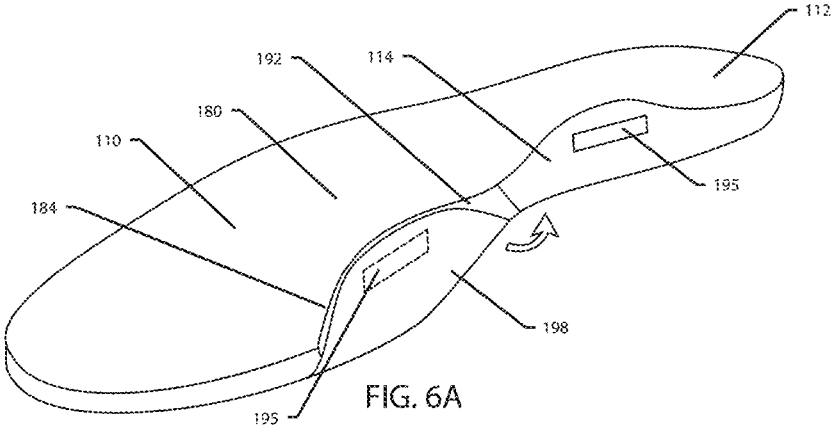
FIGS. 6A-6C illustrate different configurations of an example embodiment of a footbed having a foldable lateral adjustment fin.
Figure 6B:
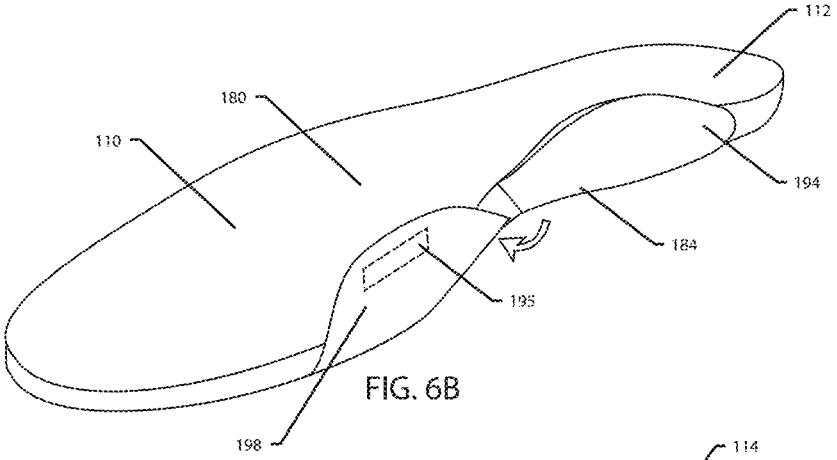
Figure 6C:
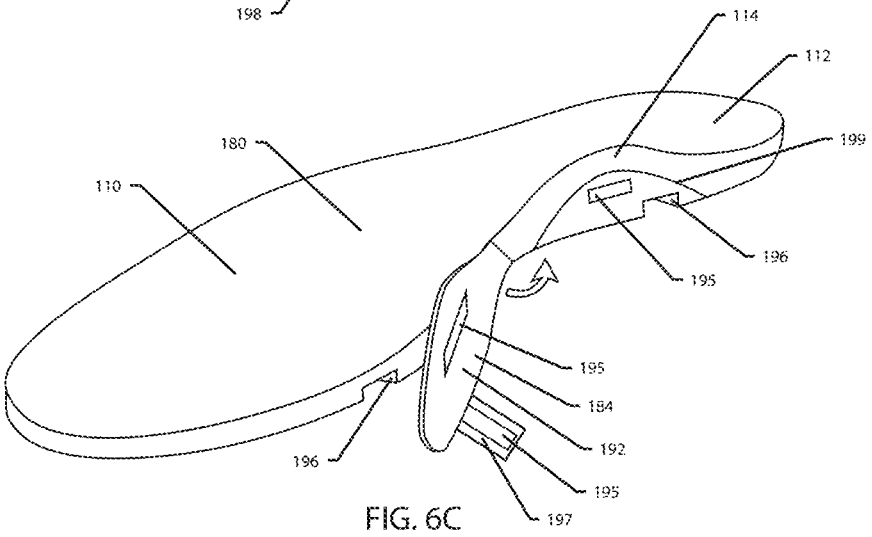

With reference to FIGS. 6A-6C, in some embodiments, the lateral adjustment fin 184 is temporarily coupled in the forward (and/or topside in some embodiments) and/or rearward (and/or underside in some embodiments) positions, for example, by one or more coupling elements 195 or the like.

In some embodiments, a rearward-facing surface 192 (or an inner surface for embodiments comprising slideable or rotatable lateral adjustment fins 184) of the lateral adjustment fin 184 can comprise coupling elements 195, and corresponding coupling elements 195 can be on the rearward portion 112 of the footbed 180, for example, at arch portion 114. Alternatively, and with particular reference to FIG. 6C, corresponding coupling elements 195 can be within a recess 196 having coupling elements, the recess 196 extending into the top, side or bottom of the rearward portion 112 for receiving a tab 197 having coupling elements 195, the tab 197 coupled to lateral adjustment fin 184.

In some embodiments, a forward-facing surface 194 (or an inner surface for embodiments comprising slideable or rotatable lateral adjustment fins 184) of the lateral adjustment fin 184 can comprise coupling elements 195, and corresponding coupling elements 195 can be on the forward portion 110 of the footbed 180, for example, with particular reference to FIG. 6C, within a recess 196 having coupling elements, the recess 196 extending into the top, side or bottom of the forward portion 110 for receiving a tab 197 having coupling elements 195, the tab 197 coupled to lateral adjustment fin 184.

In some embodiments, and with particular reference to FIGS. 6A and 6B, a rearward-facing surface 192 of the lateral adjustment fin 184 can comprise coupling elements 195, and corresponding coupling elements 195 can be on a flange 198 extending away from an edge of a forward portion 110 of the footbed 180. In this regard, the flange 198 can have coupling elements 195 on its inner surface such that coupling is achieved with coupling elements 195 located exclusively on a single side of the lateral adjustment fin 184 (i.e., the lateral adjustment fin 184 is translated past the flange 198). Alternatively, the flange 198 can have coupling elements 195 on its outer surface such that coupling is achieved with coupling elements 195 located on both sides of the lateral adjustment fin 184 (i.e., the lateral adjustment fin 184 is not translated past the flange 198).

In some embodiments, and with reference to FIG. 6C, the footbed 180 can comprise a rigid or semi-rigid reinforcement panel 199 (e.g., at an arch portion 114) for receiving the lateral adjustment fin 184, such that translation of the lateral adjustment fin 184 to and/or from arch portion 114 of footbed 180 is not noticeable by a user. Stated another way, when the lateral adjustment fin 184 is translated toward the rearward portion 112 of footbed 180, the effective thickness of the arch portion 114 of footbed 180 stays substantially the same or only nominally increases. In this regard, an inner dimension of shoe 100 within its rearward portion is not changed, or is only minimally changed (i.e., only an inner dimension in the shoe's forward portion is affected by the changed configuration).

Figure 7A:
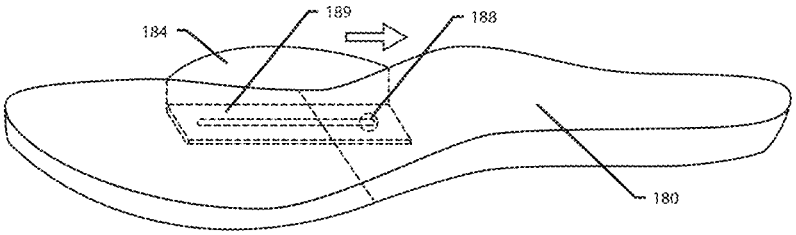
FIGS. 7A and 7B illustrate different configurations of an example embodiment of a footbed having a slideable lateral adjustment fin.
Figure 7B:
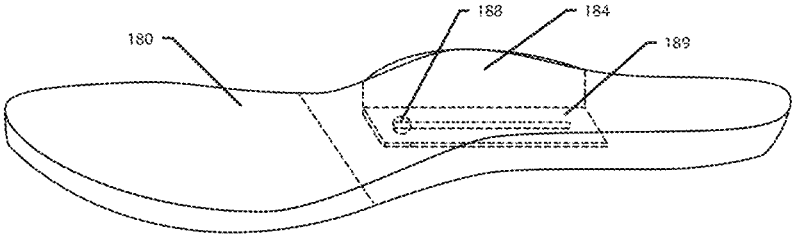

With reference to FIGS. 7A and 7B, a lateral adjustment fin 184 can be slideably coupled to a footbed 180, for example, along a track forward and rearward on an underside portion of footbed 180, or embedded within footbed 180, for example, into a rigid or semi-rigid recess for receiving the lateral adjustment fin 184. In the illustrated embodiment, the pin 188 is fixed relative to the footbed 180 and the track 189 is fixed relative to the lateral adjustment fin 184, however, in other embodiments, the pin can be fixed relative to the lateral adjustment fin 184 and the track can be fixed relative to the footbed 180.

In example embodiments, a forward and/or rearward pull cord can be attached to the lateral adjustment fin 184 and/or the track 189 (and/or to the pin 188 in the other referenced embodiment) to facilitate sliding between configurations. Such pull cord can be manually or electronically activated (e.g., with a motor).

Figure 8A:
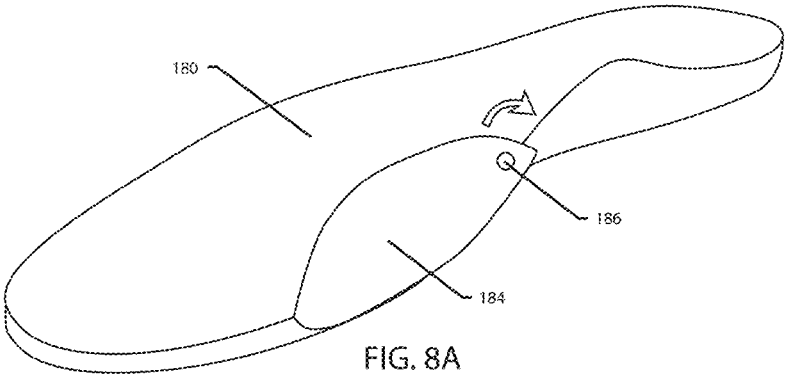
FIGS. 8A and 8B illustrate different configurations of an example embodiment of a footbed having a rotatable lateral adjustment fin.
Figure 8B:
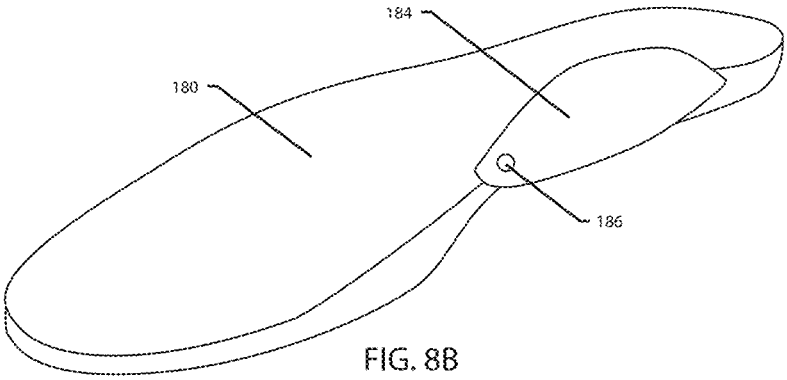

With reference to FIGS. 8A and 8B, a lateral adjustment fin 184 can be rotatably coupled to a footbed 180, for example, about a pin 186 coupled to a portion of footbed 180.

While a single lateral adjustment fin 184 is illustrated, multiple lateral adjustment fins 184 are contemplated, for example, to provide for multiple levels of adjustability. In such embodiments, one or more lateral adjustment fins 184 can have different thicknesses.

In example embodiments, one or more lateral adjustment fins 184 can have size designations (e.g., narrow, regular, wide, extra wide) imprinted thereon or affixed thereto.

In still other embodiments, one or more lateral adjustment fins 184 are completely detachable from the footbed 180.

It will be evident to those skilled in the art that the footbed 180 can comprise other panels and fins, similar in scope to those described above, to provide for different areas of adjustability.

The panels and fins described herein can be comprised in whole or in part of materials generally known in the art, including one or more rigid materials, semi-rigid materials and deformable materials (e.g., thermoplastic polyurethane (TPU), ethylene-vinyl acetate (EVA) foam, polyurethane foam, high impact/reaction foam, poly ethylene-vinyl acetate (PEVA), polyvinyl chloride, urethane or another polymer material).

The footbed 180 can be used with any shoe generally known in the art and can be sold separately from a shoe or together with a shoe as a kit.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A system for providing periodic adjustment to a dimension of a shoe comprising:
- the shoe; and
- a footbed configured to be placed inside the shoe, the footbed comprising:
  - a forward portion;
  - a rearward portion; and
  - a thickness adjustment panel;
- wherein the footbed has a forward thickness and a rearward thickness;
- wherein at least one portion of the thickness adjustment panel is coupled to the footbed and the thickness adjustment panel is configured to be translated between a first panel configuration and a second panel configuration;
- wherein the thickness adjustment panel overlaps the forward portion of the footbed in the first panel configuration;
- wherein the thickness adjustment panel overlaps the rearward portion of the footbed in the second panel configuration;
- wherein the forward thickness is decreased from the first panel configuration to the second panel configuration;
- wherein, in the second panel configuration, the thickness adjustment panel is configured to be received at least in part into the rearward portion.

2. The system of claim 1, wherein the thickness adjustment panel is either a unitary piece with the footbed and comprised of a deformable material or is hingedly coupled to the footbed, so as to be configured to fold between the first panel configuration and the second panel configuration.

3. The system of claim 1, wherein the thickness adjustment panel is configured to slide or rotate between the first panel configuration and the second panel configuration.

4. The system of claim 1, wherein the thickness adjustment panel is comprised of EVA foam or polyurethane foam.

5. The system of claim 1, wherein the thickness adjustment panel comprises a size designation imprinted thereon or affixed thereto.

6. A system for providing periodic adjustment to a dimension of a shoe comprising:
- the shoe; and
- a footbed configured to be placed within the shoe, wherein the footbed comprises:
  - a forward portion;
  - a rearward portion; and
  - a plurality of thickness adjustment panels;

wherein each of the plurality of thickness adjustment panels is configured to be translated between a first panel configuration and a second panel configuration;

wherein each of the plurality of thickness adjustment panels at least partially overlaps the forward portion of the footbed in its respective first panel configuration;

wherein each of the plurality of thickness adjustment panels at least partially overlaps the rearward portion of the footbed in its respective second panel configuration;

wherein each of the plurality of thickness adjustment panels can be temporarily coupled in its respective first panel configuration; and wherein each of the plurality of thickness adjustment panel can be temporarily coupled in its respective second panel configuration.

7. The system of claim 6, wherein each of the plurality of thickness adjustment panels is either a unitary piece with the footbed and comprised of a deformable material or is hingedly coupled to the footbed, so as to be configured to fold between its respective first panel configuration and its respective second panel configuration.

8. The system of claim 6, wherein each of the plurality of thickness adjustment panels is configured to slide or rotate between its respective first panel configuration and its respective second panel configuration.

9. The system of claim 6, wherein each of the plurality of thickness adjustment panels is comprised of EVA foam or polyurethane foam.

10. The system of claim 6, wherein each of the plurality of thickness adjustment panels comprises a size designation imprinted thereon or affixed thereto.

11. A system for providing periodic adjustment to a dimension of a shoe comprising:

the shoe; and a footbed configured to be placed within the shoe, wherein the footbed comprises:

a forward portion;

a rearward portion; and a plurality of thickness adjustment panels;

wherein each of the plurality of thickness adjustment panels is coupled to the footbed and configured to be translated between a first panel configuration and a second panel configuration;

wherein each of the plurality of thickness adjustment panels at least partially overlaps the forward portion of the footbed in its respective first panel configuration; and wherein each of the plurality of thickness adjustment panels can be temporarily coupled in its respective first panel configuration.

12. The system of claim 11, wherein each of the plurality of thickness adjustment panels is comprised of EVA foam or polyurethane foam.

13. The system of claim 11, wherein each of the plurality of thickness adjustment panels comprises a size designation imprinted thereon or affixed thereto.

* * * * *